US006084525A

United States Patent [19]

Toyota et al.

[11] Patent Number: 6,084,525

[45] Date of Patent: Jul. 4, 2000

[54] DISTRESS CALL EMITTING DEVICE

[75] Inventors: Katsunori Toyota, Tokyo; Nobuo Kimura; Masayuki Kaga, both of Nagoya, all of Japan

[73] Assignee: Kabushiki Kaisha Alpha Tsushin, Tokyo, Japan

[21] Appl. No.: 09/079,975

[22] Filed: May 14, 1998

[30] Foreign Application Priority Data

Jun. 3, 1997 [JP] Japan ..... 9-145228
Dec. 24, 1997 [JP] Japan ..... 9-355371

[51] Int. Cl.[7] ..... G08B 21/10

[52] U.S. Cl. ..... 340/690; 340/540; 340/689; 340/692; 340/693.5

[58] Field of Search ..... 340/689, 690, 340/692, 693.5, 693.6, 574, 539, 531, 533, 540

[56] References Cited

U.S. PATENT DOCUMENTS 4,730,184 3/1988 Bach ..... 340/539
4,754,266 6/1988 Shand et al. ..... 340/692
4,821,027 4/1989 Mallory et al. ..... 340/692
4,855,723 8/1989 Fritz et al. ..... 340/574
5,177,461 1/1993 Budzyna et al. ..... 340/539
5,565,844 10/1996 Bedrosian ..... 340/531
5,610,338 3/1997 Kato et al. ..... 340/690
5,644,300 7/1997 Lin ..... 340/690
5,729,203 3/1998 Oka et al. ..... 340/574

*Primary Examiner*—Glen Swann
*Attorney, Agent, or Firm*—Skjerven, Morrill, Macpherson, Franklin, & Friel, LLP; Theodore P. Lopez

[57] ABSTRACT

The distress call emitting device comprises an earthquake sensor for detecting an earthquake of a prescribed intensity or greater and/or a receiver for receiving a radio signal from a remote transmitter. Therefore, even when the user is unable to call for a help, the distress call emitting device of the present invention produces a distress call in his behalf by sound and/or light. The distress call can be initiated either by detecting the intensity of the earthquake or by operating a remote transmitter which may be carried by the user. If the device is linked to a telephone line, the distress call can be made also through a telephone line. Thus, even when the user is too weak to call for a help by his own effort, the device is either automatically activated by an earthquake or remotely activated by pressing a switch on a portable transmitter.

10 Claims, 4 Drawing Sheets

DISTRESS CALL EMITTING DEVICE

TECHNICAL FIELD

The present invention relates to a distress call emitting device for emitting a distress message or an alarm signal to people outside a room when a rescue effort is required inside the room, and in particular to an alarm device which is suitable for use in households including blind, handicapped, ill or otherwise infirm members.

BACKGROUND OF THE INVENTION

Households including infirm members may need to call for a help to rescue teams and neighbors in case of an accident or a sudden worsening of a sickness. Such household members may not be able to call for a help by their own efforts. Therefore, it has been proposed to install a switch in the house to emit an alarm to the outside or to make a call to a rescue team or a neighbor.

However, in case of an accident or a sudden worsening of a sickness, the affected person may not be able to reach the switch or to operate it depending on the position of the affected person at the time of the accident or the sudden worsening of the sickness. Also, even when a telephone call has been made, the disabled person may still be unable to request a help by speech on the phone. In certain situations, such as an intense earthquake, even an able-bodied person could be buried in debris, and immobilized to such an extent that he may not be able to call for help by his own effort.

BRIEF SUMMARY OF THE INVENTION

In view of such problems of the prior art, a primary object of the present invention is to provide a distress call emitting device which allows even an infirm person to call for a help to the outside without any difficulty.

A second object of the present invention is to provide a distress call emitting device which allows a person immobilized in a room or a house can direct the attention of a rescue team or neighbors so that a rescue effort may be made without any delay.

A third object of the present invention is to provide a distress call emitting device which allows a distress call to be made under any circumstances.

A fourth object of the present invention is to provide a distress call emitting device which is easy to operate and reliable in use.

A fifth object of the present invention is to provide a distress call emitting device which is compact and economical.

According to the present invention, such objects are accomplished by providing a distress call emitting device adapted to be installed outside a room or a house occupied by a person who may require a rescue effort, comprising: an alarm unit for emitting a distress message by sound and/or light; alarm triggering means; a controller for activating the alarm unit upon receiving a command signal from the alarm triggering means; and a battery power source for powering the alarm unit, alarm triggering means, and the controller.

The alarm triggering means may consist of any sensor which can detect an emergency situation either automatically or by human intervention. For instance, the alarm triggering means may comprise an earthquake sensor for detecting an earthquake having a prescribed intensity or greater. In this case, if the earthquake sensor may be based on detection of acceleration, the tilting of the device can be detected as a change in the direction of the gravitational acceleration, and the tilting of the building can be also detected. Therefore, the device is required to be installed horizontally, and it can be conveniently accomplished if the device is equipped with a level gauge.

Thus, even when the user is unable to call for a help for instance placed under the debris of the building, the distress call emitting device of the present invention can produce a distress call in his behalf by sound and/or light. It will be highly effective in drawing the attention of the neighbors and rescue teams if the alarm is produced as synthesized speech. The device is expected to be highly useful for households including infirm members who may be infirm or handicapped, and would require immediate attention in case of an earthquake or similar catastrophic situations.

If the device is equipped with a receiver for activating the device with a radio signal transmitted by a remote transmitter carried by the user, it is also helpful in directing the attention of neighbors and a rescue team in case of an accident or a sudden worsening of a sickness. The transmitter may be provided with a wrist band adapted to be worn on a wrist of the user so that the user can wear it comfortably at all times. Thus, the alarm unit serves both for an earthquake distress call emitting device which is adapted to be automatically activated by detecting the occurrence of a strong earthquake, and a general distress call emitting device which is adapted to be activated by the user. This increases the versatility of the device without substantially increasing the cost. In particular, the receiver may consist of an optional unit which may be added to an earthquake distress call emitting device.

If the device is linked to a telephone line, the distress call can be made also through a telephone line. Such an automatic telephoning unit may be provided separately from the main body of the distress call emitting device, and may be provided with a receiver for receiving a radio signal from the transmitter carried by the user. Alternatively, the automatic telephoning unit may be incorporated in the main body so as to be activated by a detection signal from the earthquake sensor.

If the device further comprises an automatic telephoning unit including another radio receiver for receiving a radio signal from the portable transmitter, an automatic telephoning unit for making a call to a designated party upon receiving the radio signal, and an announcement unit which forwards a prescribed distress message or an alarm to the designated party to whom the call has been made, the user can make a telephone call from a remote location even when he is unable to speak, without adding any device that must be carried by the user, and without complicating the method of using the device.

BRIEF DESCRIPTION OF THE DRAWINGS

Now the present invention is described in the following with reference to the appended drawings, in which:

FIG. 2(*b*) is a right side view,

FIG. 2(*c*) is a top view, and

FIG. 2(*d*) is a bottom view of the earthquake distress call emitting device;

DETAILED DESCRIPTION OF THE PREFERRED EMBODIMENTS

Figure 1:
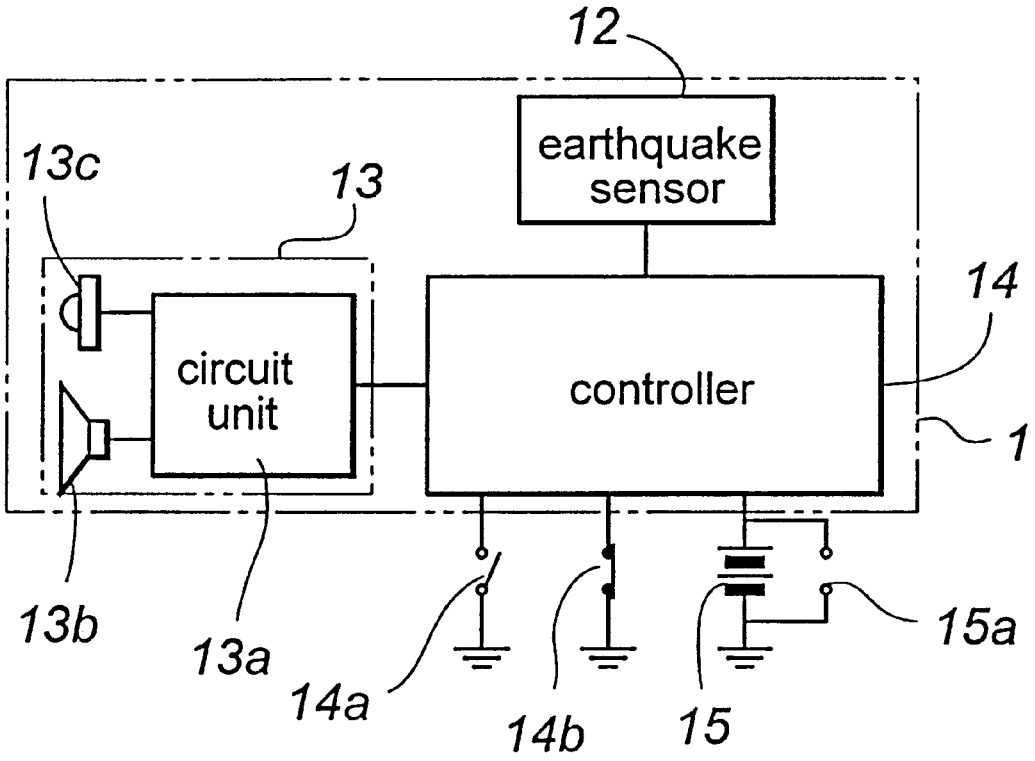
FIG. 1 is a block diagram of an earthquake distress call emitting device given as a first embodiment of the present invention.
Figure 2:
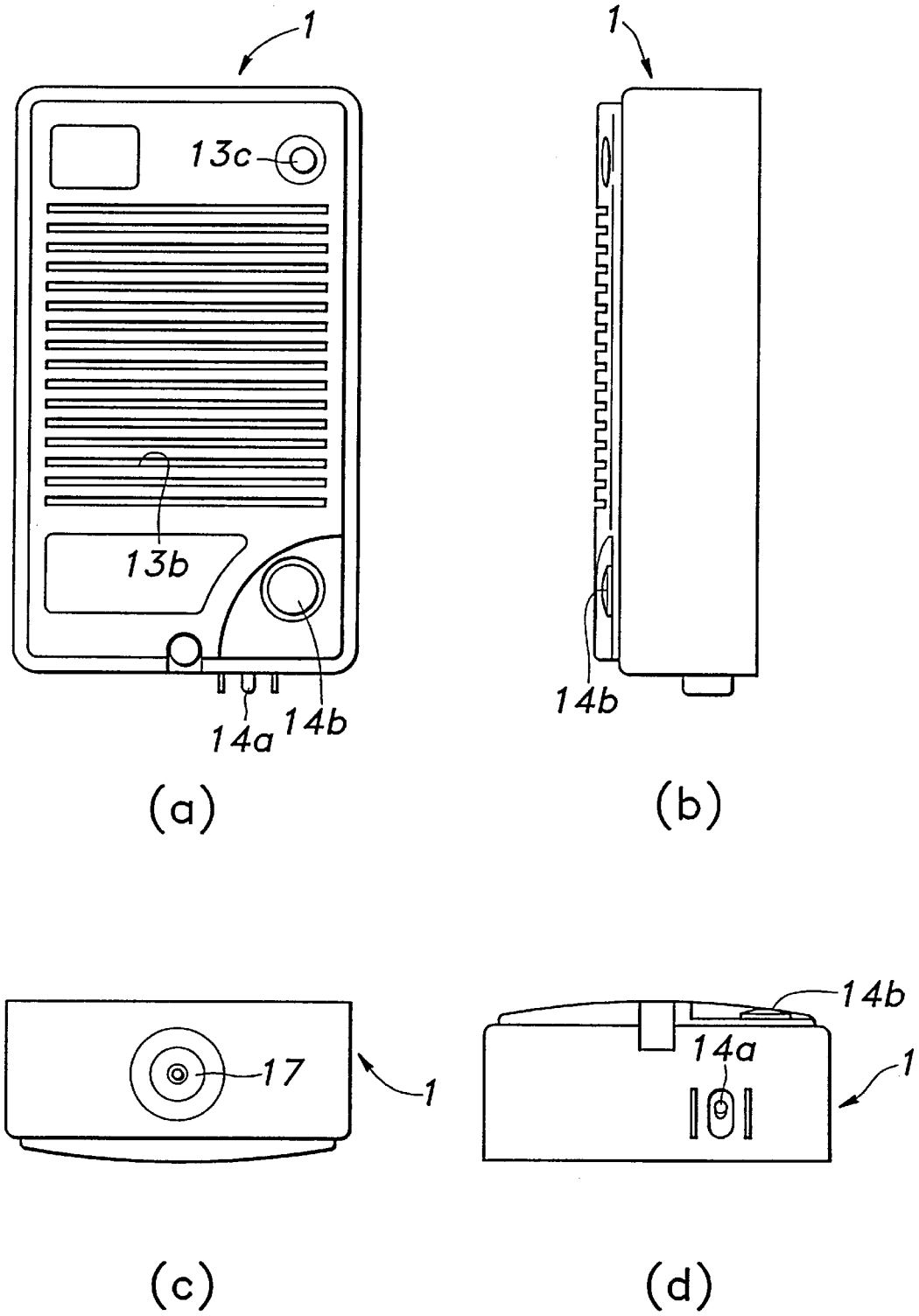
FIG. 2(*a*) is a front view.

FIG. 1 is a block diagram of a distress call emitting device embodying the present invention, and FIGS. 2(*a*) to 2(*d*) show the external appearance of the distress call emitting device. This device comprises a main body 1 accommodated in a rectangular box-shaped casing which is adapted to be installed, for instance, on the exterior wall of a house, a transmitter 2 constructed much like a wristwatch so as to be easily carried around, and a telephoning unit 3 which is adapted to be connected to a telephone line in the room.

The casing of the main body 1 is preferably strong enough to survive and earthquake or other extreme conditions. The main body 1 includes an earthquake sensor 12, an alarm unit 13 for emitting a distress message and/or an alarm by using sound and light, a controller 14 for controlling the earthquake sensor 12 and the alarm unit 13, and a rechargeable battery power source 15. A level gauge 17 for allowing the device to be installed in a horizontal orientation is provided in an upper part of the casing.

The earthquake sensor 12, for instance, may consist of a balanced force accelerometer. This balanced force accelerometer comprises a freely moveable pendulum, a displacement sensor for detecting a displacement of a tip of the pendulum, and a magnet and a moving coil for producing a restoring force for urging the pendulum to its rest position. At the time of an earthquake, the pendulum moves, and this movement causes an imbalance voltage in the displacement sensor. This voltage is amplified, and supplied to the moving coil, thereby producing a torque which tends to restore the pendulum to the rest position. The electric current flowing through the moving coil is proportional to the acceleration or the magnitude of the earthquake, and is forwarded to the controller 14 as the detection signal indicative of the magnitude of the earthquake. A building can collapse even when the acceleration is not significant. In such a case, because the earthquake sensor 12 is also capable of detecting the tilting of the building, the tilting of the building by more than a prescribed angle can be detected as an effective detection signal.

The alarm unit 13 comprises a circuit unit 13*a* including memory for storing speech data, a D/A converter, and an amplifier, a loudspeaker 13*b*, and an alarm lamp 13*c* consisting of an LED or the like. Upon receiving a command output from the controller 14, a distress message such as "help me" stored in the memory of the circuit unit 13*a* and a buzzer sound (alarm sound) are produced from the loudspeaker 13*b*, and, at the same time, the alarm lamp 13*c* either lights up or flashes at a regular interval.

The controller 14 which may consist of an IC is constructed so as to issue a distress message and an alarm from the alarm unit 13 when the value of the detection signal from the earthquake sensor 12 corresponds to a seismic intensity scale of 5 (90 $cm/s^2$ to 170 $cm/s^2$) or more. The controller 14 is provided with a power switch 14*a* and a reset switch 14*b* which are exposed out of the main body 1. The battery power source 15 may, for instance, consist of a rechargeable lithium battery, and can be, constantly or at a suitable timing, recharged via a jack 15*a* exposed from the lower surface of the main body 1.

The mode of operation of the alarm device of this embodiment is described in the following. First of all, the main body 1 is horizontally attached to the exterior wall of the house of a blind, handicapped or ill person with the aid of the level gauge 17 by using screws or two-side adhesive tape. Power is then supplied to the main body 1 by pressing the power switch 14*a* to put the distress call emitting device ready for operation.

When an earthquake of a seismic intensity scale of 5 (90 $cm/s^2$ to 170 $cm/s^2$) or more occurs, the earthquake sensor 12 is activated, and a corresponding detection signal is forwarded to the controller 14. Upon receiving such a detection signal, the controller 14 activates the sound source for the alarm sound and the distress message, and produces an alarm sound and the distress message from the loudspeaker 13*b* while the alarm lamp 13*c* either lights up or flashes at a regular interval. The alarm action continues as long as the battery power source 15 lasts. Thereby, the need for a rescue effort in this house can be readily identified from outside, and a rescue effort can be started without any delay. When it is desired to turn off the alarm sound and the alarm lamp, it can be accomplished by pressing the reset switch 14*b*.

Figure 3:
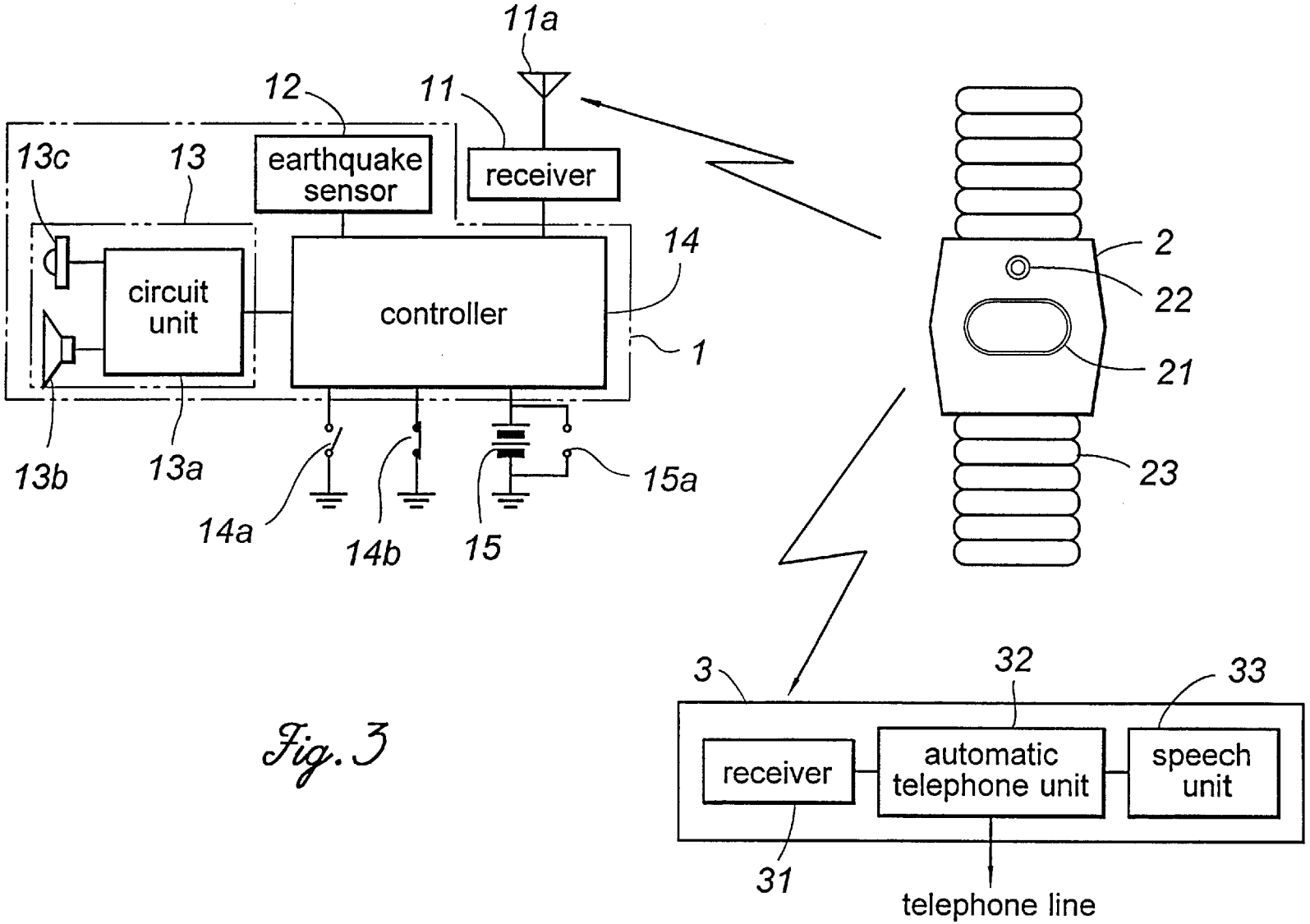
FIG. 3 is a block diagram of a general distress call emitting device given as a second embodiment of the present invention.
Figure 4:
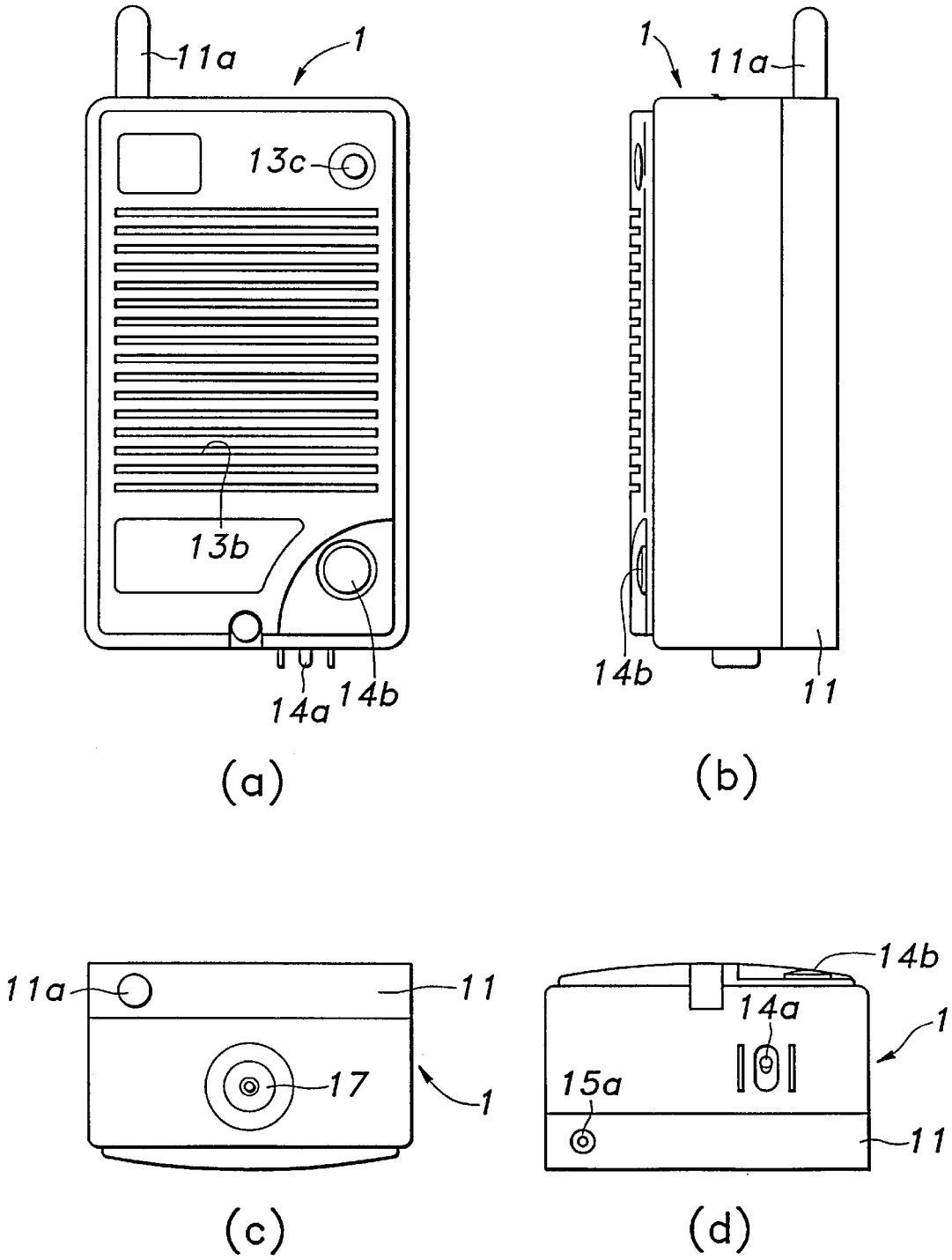
FIG. 4(*a*) is a front view, FIG. 4(*b*) is a right side view, FIG. 4(*c*) is a top view, and FIG. 4(*d*) is a bottom view of the general distress call emitting device.

FIG. 3 shows a second embodiment the distress message emitting device according to the present invention, and FIGS. 4(*a*) to 4(*d*) show the external appearance of the distress call emitting device. The parts corresponding to those of the first embodiment are denoted with like numerals. This distress message emitting device additionally includes a transmitter 2 constructed much like a wristwatch so as to be easily carried around, and a telephoning unit 3 which is adapted to be connected to a telephone line in the room.

The main body 1 is constructed substantially identical to the main body 1 of the first embodiment, and the receiver 11 is adapted to be attached to the back surface of the main body 1. Thus, the receiver 11 is interposed between the main body 1 and the wall surface. Therefore, the main body 1 may be interchangeably used either as a simple earthquake distress call emitting device according to the first embodiment of the present invention or a combined distress call emitting device according to the second embodiment of the present invention.

The receiver 11 comprises an antenna 11*a* projecting from an upper part of the casing of the receiver 11, and forwards a signal to the controller 14 upon receiving a radio signal from the transmitter 2 via cooperating contact sets (not shown in the drawings) provided in the opposing faces of the main body 1 and the receiver 11 as described hereinafter.

The front surface of the transmitter 2 is provided with a transmission switch 21, and a transmission acknowledgement lamp 22 consisting of an LED. When the transmission switch 21 is pressed by the user, a radio signal is forwarded to the receiver 11, and the transmission acknowledgement lamp 22 flashes. The transmitter 2 is fitted with an elastic stainless steel wrist band 23 so that the transmitter 2 may be worn on the wrist of the user at all times.

The telephoning unit 3 comprises another receiver 31 which is separate from the receiver 11 for receiving a radio signal from the portable transmitter 2, an automatic telephone unit 32 which makes a call to a predetermined party or to each of a number of predetermined parties upon receiving a radio signal from the transmitter, and a speech synthesizing unit 33 for pronouncing the address and name of the caller and a distress message. This telephoning unit 3 is adapted to be connected between a telephone and a telephone line, and may be incorporated in the receiver 11 or may be accommodated in a small box which may be located separately from the receiver 11.

The mode of operation of the alarm device of this embodiment is described in the following. First of all, the main body 1 is horizontally attached to the exterior wall of the house of a blind, handicapped or ill person with the aid of the level gauge 17 by using screws or two-side adhesive tape. Power is then supplied to the main body 1 by pressing the power switch 14*a* to put the distress call emitting device ready for operation.

In case of an accident or a sudden worsening of an illness, by pressing the transmission switch 21 of the transmitter 2, a radio signal from the transmitter 2 is received by the receiver 11 of the main body 1, and is forwarded to the controller 14. This causes a distress message and/or a buzzer sound to be produced from the loudspeaker 13*b*, and the alarm lamp 13*c* to light up or to flash. This alarm action continues as long as the battery power source 15 lasts. Thereby, the need for a rescue effort in this house can be readily identified from outside, and a rescue effort can be started without any delay.

At the same time, the radio signal from the transmitter is received also by the receiver 31 of the telephoning unit 3 which in turn makes a call to a single designated party or to a plurality of designated parties by using the automatic telephone unit 32 to notify the name and address of the caller, and a distress message by speech produced from the speech synthesizing unit 33. Therefore, even when the user is too weak to pick up a telephone or is immobilized due to sickness or an accident, simply by pressing the switch on the wrist band, he can call for a help by telephone, and an accurate and timely rescue effort can be made.

Thus, according to the present invention, even when the user is unable to call for a help, the distress call emitting device of the present invention produces a distress call in his behalf by sound and/or light. The distress call can be initiated either by detecting the intensity of the earthquake or by operating a remote transmitter which may be carried by the user. If the device is linked to a telephone line, the distress call can be made also through a telephone line.

Therefore, this device is expected to be highly useful for households including infirm members who may be infirm or handicapped, and would require immediate attention in case of an earthquake or similar catastrophic situations. If the device is equipped with a remote transmitter for activating the device, it is also helpful in directing the attention of neighbors and a rescue team in case of an accident or a sudden worsening of a sickness.

Although the present invention has been described in terms of preferred embodiments thereof, it is obvious to a person skilled in the art that various alterations and modifications are possible without departing from the scope of the present invention which is set forth in the appended claims.

What is claimed is:

1. A distress call emitting device adapted to be installed outside a room or a house occupied by a person who may require a rescue effort comprising:

an alarm unit for emitting a distress message by sound and/or light;

alarm triggering means including a radio receiver for receiving a radio signal from a remote transmitter, said alarm triggering means capable of generating a command signal in response to the received radio signal;

a controller for activating said alarm unit upon receiving the command signal from said alarm triggering means; and a battery power source for powering said alarm unit, said alarm triggering means, and said controller, said remote transmitter being of a wristwatch type configured to be worn on a wrist of a user.

2. A distress call emitting device according to claim 1, wherein said alarm unit further comprises an automatic telephoning unit for making a call to a designated party and announcing a prescribed message by speech when activated by said controller.

3. A distress call emitting device according to claim 2, wherein said automatic telephoning unit is provided separately from a main body including the alarm unit, the alarm triggering means, and the controller, and is provided with another receiver adapted to receive a radio signal from said transmitter.

4. A distress call emitting device according to claim 2, wherein said prescribed message is produced by synthesized speech.

5. A distress call emitting device according to claim 2, wherein said prescribed message comprises at least one of the name and address of the person who may require a rescue effort.

6. A distress call emitting device according to claim 1, wherein said distress message is produced by synthesized speech.

7. A distress call emitting device according to claim 1, wherein said distress message comprises at least one of the name and address of the person who may require the rescue effort.

8. A distress call emitting device adapted to be installed outside a room or a house occupied by a person who may require a rescue effort comprising:

an alarm unit for emitting a distress message by speech, sound and/or light;

alarm triggering means including a radio receiver for receiving a radio signal from a remote transmitter, said alarm triggering means capable of generating a command signal in response to the received radio signal;

a controller for activating said alarm unit upon receiving the command signal from said alarm triggering means; and a battery power source for powering said alarm unit, said alarm triggering means, and said controller, wherein said alarm triggering means further comprises an earthquake sensor for detecting an earthquake having a prescribed intensity or greater, said remote transmitter being of a wristwatch type configured to be worn on a wrist of a user, said alarm triggering means being capable of generating the command signal upon detection of the earthquake.

9. A distress call emitting device according to claim 8, wherein said earthquake sensor is based on detection of acceleration, and can additionally detect a tilting of the device.

10. A distress call emitting device according to claim 9, further comprising a level gauge for allowing the device to be installed horizontally.

* * * * *